US009060912B2

(12) United States Patent
Drew et al.

(10) Patent No.: US 9,060,912 B2
(45) Date of Patent: Jun. 23, 2015

(54) CASKET AND DISPLAY BASE

(71) Applicant: Batesville Services, Inc., Batesville, IN (US)

(72) Inventors: Travis Edward Drew, Batesville, IN (US); Daniel G. Meiser, Wilder, KY (US); Ilija Rojdev, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 14/230,797

(22) Filed: Mar. 31, 2014

(65) Prior Publication Data

US 2014/0208552 A1 Jul. 31, 2014

Related U.S. Application Data

(62) Division of application No. 13/679,668, filed on Nov. 16, 2012, now Pat. No. 8,689,411.

(60) Provisional application No. 61/561,356, filed on Nov. 18, 2011.

(51) Int. Cl.
*A61G 17/007* (2006.01)
*B21D 51/52* (2006.01)

(52) U.S. Cl.
CPC ..... *A61G 17/0076* (2013.01); *B21D 51/52* (2013.01); *Y10T 29/49826* (2015.01)

(58) Field of Classification Search
CPC ..... A61G 17/00; A61G 17/0076; A61G 2017/00; B21D 51/52; Y10T 29/49826; Y10T 29/49904
USPC ..... 27/2, 6, 27, 35; 211/85.16; 29/428, 469; 413/1
See application file for complete search history.

(56) References Cited

U.S. PATENT DOCUMENTS

| | | | | | |
|---|---|---|---|---|---|
| 2,214,889 | A | * | 9/1940 | Purkiss | 27/5 |
| 2,494,577 | A | * | 1/1950 | Paden | 27/6 |
| 2,503,293 | A | * | 4/1950 | Paden | 27/6 |
| 2,582,841 | A | * | 1/1952 | McEwan | 27/17 |
| 2,587,355 | A | * | 2/1952 | McEwan | 27/18 |
| 3,810,282 | A | * | 5/1974 | Doggett | 27/35 |
| 3,924,309 | A | * | 12/1975 | Andrus et al. | 27/2 |
| 4,237,590 | A | * | 12/1980 | Work | 27/35 |
| 4,265,006 | A | * | 5/1981 | Angermann | 27/14 |

(Continued)

*Primary Examiner* — William Miller
(74) *Attorney, Agent, or Firm* — Wood, Herron & Evans, LLP

(57) ABSTRACT

A combination casket and casket display comprises a reduced height casket shell adapted to receive the remains of a deceased and having a pair of side walls, a pair of end walls, and a bottom wall, the side walls and end walls having lower edges, the bottom wall extending below the lower edges of the side walls and end walls, a casket lid closable on the reduced height casket shell, and a casket display base having a pair of side walls and a pair of end walls, the side walls and end walls having upper edges. The reduced height casket shell is supported by the casket display base such that the lower edges of the side walls and end walls of the reduced height casket shell are at about the same height as the upper edges of the side walls and end walls of the casket display base, and the bottom wall of the reduced height casket shell extends below the upper edges of the side walls and end walls of the casket display base so as to nest within the casket display base. A combined height of the reduced height casket shell and display base is about equal to a height of a conventional height casket shell.

8 Claims, 11 Drawing Sheets

(56) References Cited

U.S. PATENT DOCUMENTS 4,337,556 A * 7/1982 Winburn et al. ..... 27/2
4,372,018 A * 2/1983 Miller et al. ..... 27/35
4,523,358 A * 6/1985 Semon ..... 27/6
5,197,169 A * 3/1993 Gordon ..... 27/27
5,481,785 A * 1/1996 Minton et al. ..... 27/27
6,243,931 B1 * 6/2001 Linville et al. ..... 27/14
2011/0296656 A1 * 12/2011 Filipek et al. ..... 27/19

* cited by examiner

CASKET AND DISPLAY BASE

RELATED APPLICATIONS

This application claims the priority benefit of U.S. Provisional Patent Application No. 61/561,356 filed Nov. 18, 2011, which is hereby incorporated by reference herein as if fully set forth in its entirety.

FIELD OF THE INVENTION

This invention relates generally to caskets, and more particularly to caskets and bases wherein the casket is displayed atop the base.

BACKGROUND OF THE INVENTION

A conventional casket has a casket shell adapted to receive the remains of a deceased, and a casket lid or pair of lids pivoted to the shell. The shell of a conventional casket has a pair of side walls, a pair of end walls, and a bottom wall. The side walls and end walls of a conventional casket shell are about 15.5 inches high. Accordingly, there is a significant amount of raw material required to manufacture a conventional casket shell. Moreover, a conventional casket shell requires a number of manufacturing steps, many of which are manual due to the fact that the particular manufacturing step does not lend itself well to automation. Thus, the manufacture of a conventional casket shell is labor intensive.

One commonly employed process currently utilized to form sheet metal casket shells is as follows: Two side panels are blanked from a coil of sheet steel (or other suitable sheet metal), and two end panels are blanked from the coil. Next, both side panels and both end panels are stamped to form the desired profile of the shell side walls and end walls. Next, the four walls are loaded onto a weld fixture and welded together by welders, as are the flange miter corners, and finally the four welds are ground smooth with grinders. At some point along the way a bottom wall or panel is welded to the side walls and the end walls. The corners of a rounded corner casket shell are typically formed as a part of the end panels, whereas the corners of a square corner casket shell are formed by joining the side walls and ends walls at miters. Thus, the weld lines where the side panels are welded to the end panels on rounded corner casket shells are located on the ends of the side panels, thus being visible when the casket shell is viewed from the front (or rear).

This current process of forming sheet metal casket shells includes a number of disadvantages. Each panel requires at least one blanking operation along with one or two stamping operations. The sheets must be loaded into a first press to be blanked, and then moved to a second press to be stamped. The panels are then moved to a new location where they are loaded onto a fixture that holds the panels in the correct assembled orientation. Each corner is then welded either manually or robotically. The corners contain intricate profiles which add complexity to the welding operation. The welded shell is then moved to a new location where each weld is manually rough ground. Because of the intricate profiles the grinding must be done at a slower pace to insure that only unwanted weld is removed. The shell is then placed on line where the corners are eventually manually finish sanded. All of these operations are labor intensive, and because of the repeated handling of the parts, the parts are susceptible to dents and dings. The welding operations require energy for the welder and consume welding wire. The grinding and sanding operations require energy, consume numerous sanding discs, and produce dust and debris.

It is therefore desirable to improve upon this current method of forming sheet metal casket shells by reducing the amount of raw material required to manufacture the casket shell and by reducing the number of manufacturing steps, particularly manual manufacturing steps, required to manufacture the casket shell.

SUMMARY OF THE INVENTION

In one aspect, a combination casket and casket display comprises a reduced height casket shell adapted to receive the remains of a deceased and having a pair of side walls, a pair of end walls, and a bottom wall, the side walls and end walls having lower edges, the bottom wall extending below the lower edges of the side walls and end walls, a casket lid closable on the reduced height casket shell, and a casket display base having a pair of side walls and a pair of end walls, the side walls and end walls having upper edges. The reduced height casket shell is supported by the casket display base such that the lower edges of the side walls and end walls of the reduced height casket shell are at about the same height as the upper edges of the side walls and end walls of the casket display base, and the bottom wall of the reduced height casket shell extends below the upper edges of the side walls and end walls of the casket display base so as to nest within the casket display base. A combined height of the reduced height casket shell and display base is about equal to a height of a conventional height casket shell.

The lower edges of the side walls and end walls of the reduced height casket shell can be supported on the upper edges of the side walls and end walls of the casket display base. Alternatively, the bottom wall of the reduced height casket shell can be supported on a cradle or a pair of cradles mounted in the casket display base. The said side walls and end walls of the reduced height casket shell can have a height of about 6 inches, and the side walls and ends walls of the casket display base have a height of about 12 inches. The bottom wall of the reduced height casket shell can extend below the lower edges of the side walls and end walls of the reduced height casket shell by about 3.5 inches. The reduced height casket shell and casket display base thus create an appearance of being a conventional height casket shell. The cross-sectional profiles of the side walls and end walls of the reduced height casket shell and of the side walls and end walls of the display base can be configured such that the combined profiles of the reduced height casket shell and base closely match a desired cross-sectional profile of a given conventional height casket shell. The casket and casket display can be fabricated of sheet metal. If fabricated of sheet metal, the reduced height casket shell can be stamped from a single piece of sheet metal so as to be substantially seamless. The casket and casket display can also be fabricated of wood. The bottom wall of the reduced height casket shell can be curved or flat. If curved, feet can be mounted to the bottom wall.

In another aspect, a method of displaying a plurality of caskets comprises the steps of providing a plurality of caskets each having a reduced height casket shell adapted to receive the remains of a deceased and having a pair of side walls, a pair of end walls, and a bottom wall that extends below the lower edges of the side walls and end walls and a casket lid closable on the reduced height casket shell, providing a casket display base having a pair of side walls and a pair of end walls, and sequentially positioning each of the plurality of caskets on the casket display base, wherein each of the plurality of caskets and the casket display base are configured such that a combined height of the reduced height casket shell of each of the plurality of caskets positioned on the casket display base is about equal to a height of a conventional height casket shell.

The plurality of caskets and the casket display base can be configured such that the reduced height casket shell of each casket is supported by the casket display base such that the lower edges of the side walls and end walls of the reduced height casket shell are at about the same height as the upper edges of the side walls and end walls of the casket display base, and such that the bottom wall of the reduced height casket shell extends below the upper edges of the side walls and end walls of the casket display base so as to nest within the casket display base. The step of positioning each of the plurality of caskets on the casket display base can comprise supporting the lower edges of the side walls and end walls of the reduced height casket shell on the upper edges of the side walls and end walls of the casket display base, or supporting the bottom wall of the reduced height casket shell on a cradle or a pair of cradles mounted in the casket display base. The cross-sectional profiles of the side walls and end walls of the reduced height casket shell and of the side walls and end walls of the display base can be configured such that the combined profiles of the reduced height casket shell and base closely match a desired cross-sectional profile of a given conventional height casket shell. The plurality of caskets and the casket display base can be fabricated of sheet metal. If fabricated of sheet metal, the reduced height casket shell can be stamped from a single piece of sheet metal so as to be substantially seamless.

In another aspect, a method of forming a sheet metal casket shell having two side walls, two end walls, and a bottom wall is provided. The method comprises the steps of providing a rectangular sheet of sheet metal having two side edges, two end edges and four corners, stamping the sheet of sheet metal to form the side walls, end walls, and bottom wall of the casket shell in such dimensions as create a sufficient volume in which to receive and contain a body of a deceased, notching the corners of the sheet of sheet metal, forming flange side walls and top walls in the side edges and end edges of the sheet of sheet metal, rotating the side edges and end edges of the sheet of sheet metal about 90 degrees inwardly to form flange miter corners and to position the flange side walls generally vertically and the flange top walls generally horizontally, welding the flange miter corners, and grinding the flange miter corner welds.

The casket and display base of this invention provides a number of advantages. The labor and materials costs to produce the casket with reduced height casket shell are lower than the costs to produce a casket with a conventional height casket shell. This is due to the reduced amount of raw material required for the reduced height casket shell, and due to the ability to stamp the reduced height casket shell from a single piece of sheet metal so as to be substantially seamless. The stamping operation eliminates all the welding and grinding steps in the current casket shell fabrication method discussed above with the exception of welding and grinding the shell flange miter corners. It also eliminates unsightly weld lines, as well as reduces quality control issues in general. Since the body of the deceased is positioned closer to, at, or above the upper edges of the side walls and the end walls of the casket shell, no complicated bed frame and bed frame lift/tilt mechanism are needed. The casket display base can be reused by the funeral director. A number of different style display bases can be kept on hand by the funeral director to be paired with various caskets of the reduced height casket shell variety to provide various different "looks" depending on family preference. Even though the casket is fabricated with a reduced height shell, the combination of casket and display base nevertheless maintains the look of a conventional casket with a conventional height casket shell.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
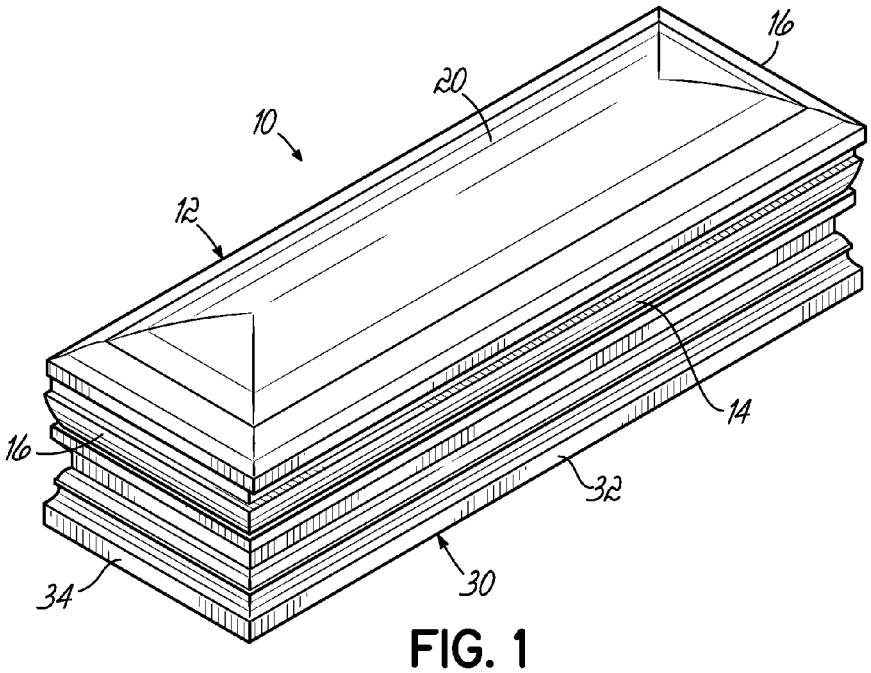
FIG. 1 is an assembled perspective view of one embodiment of the casket and casket display.
Figure 2:
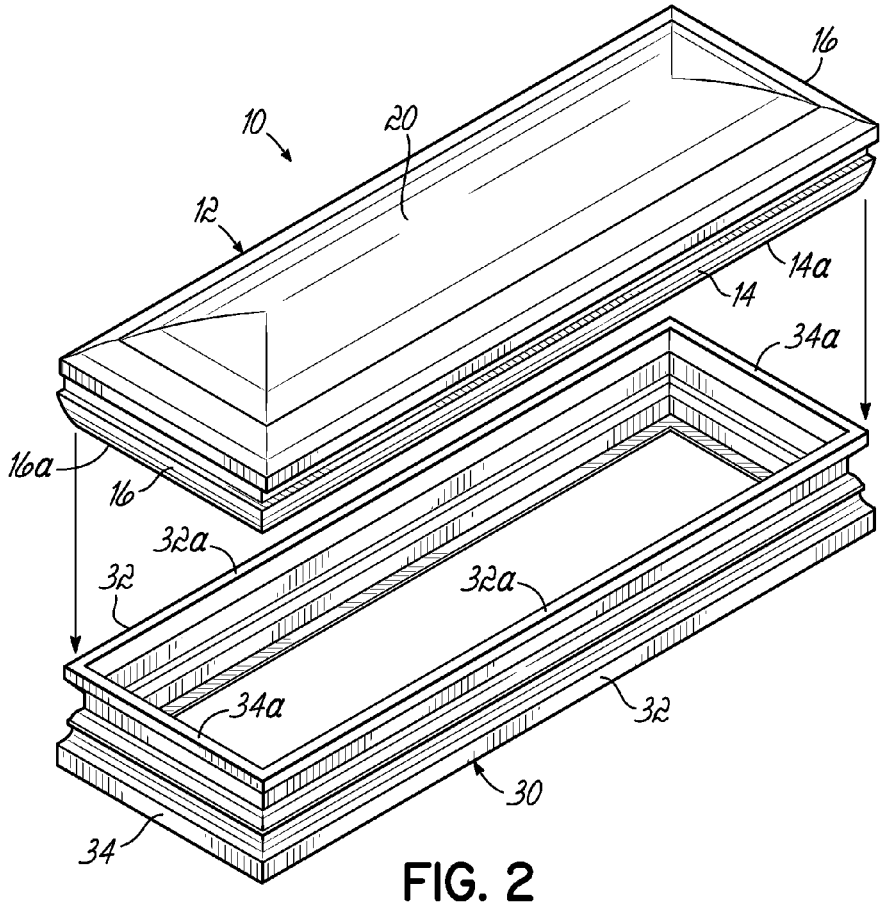
FIG. 2 is a disassembled perspective view of the casket and casket display of FIG. 1.
Figure 3:
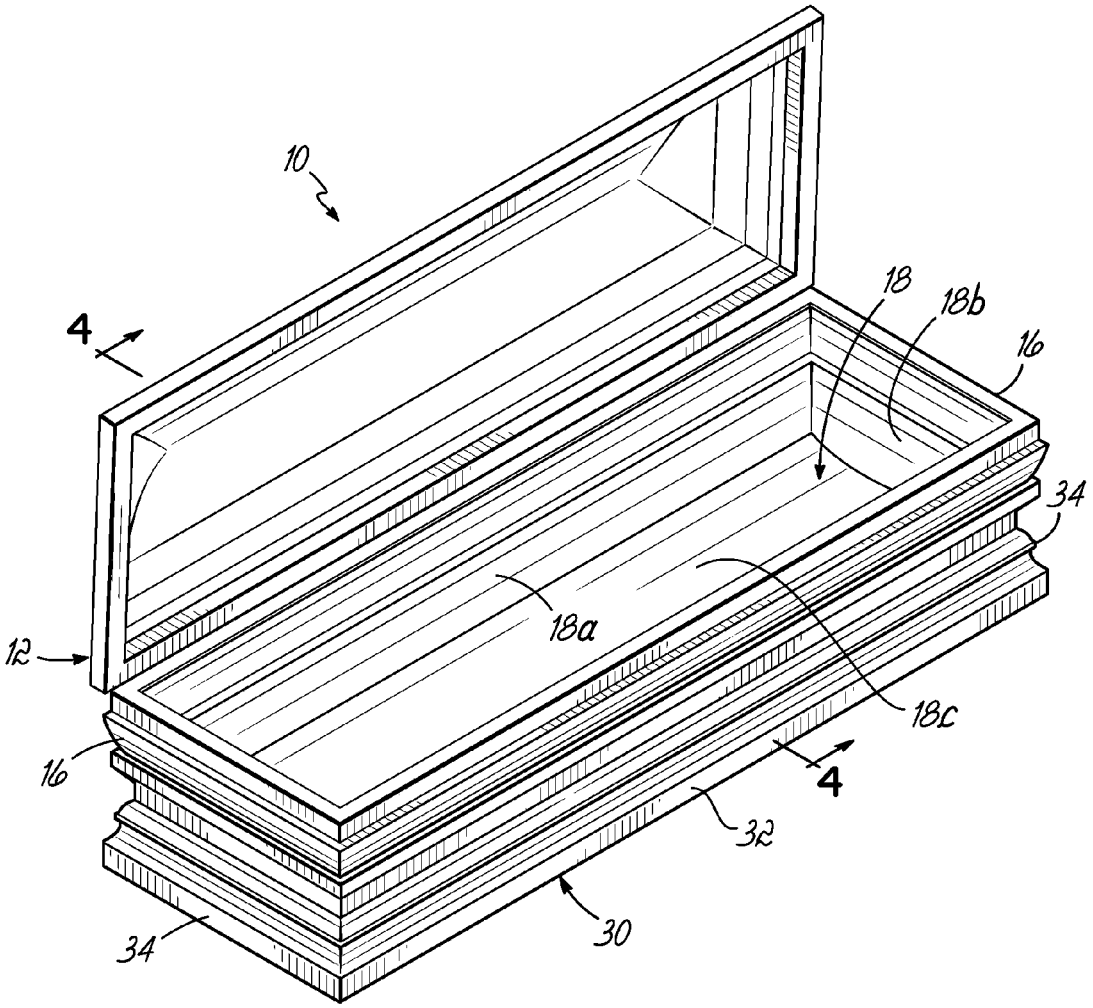
FIG. 3 is a view similar to FIG. 1 but with the casket lid open.
Figure 4:
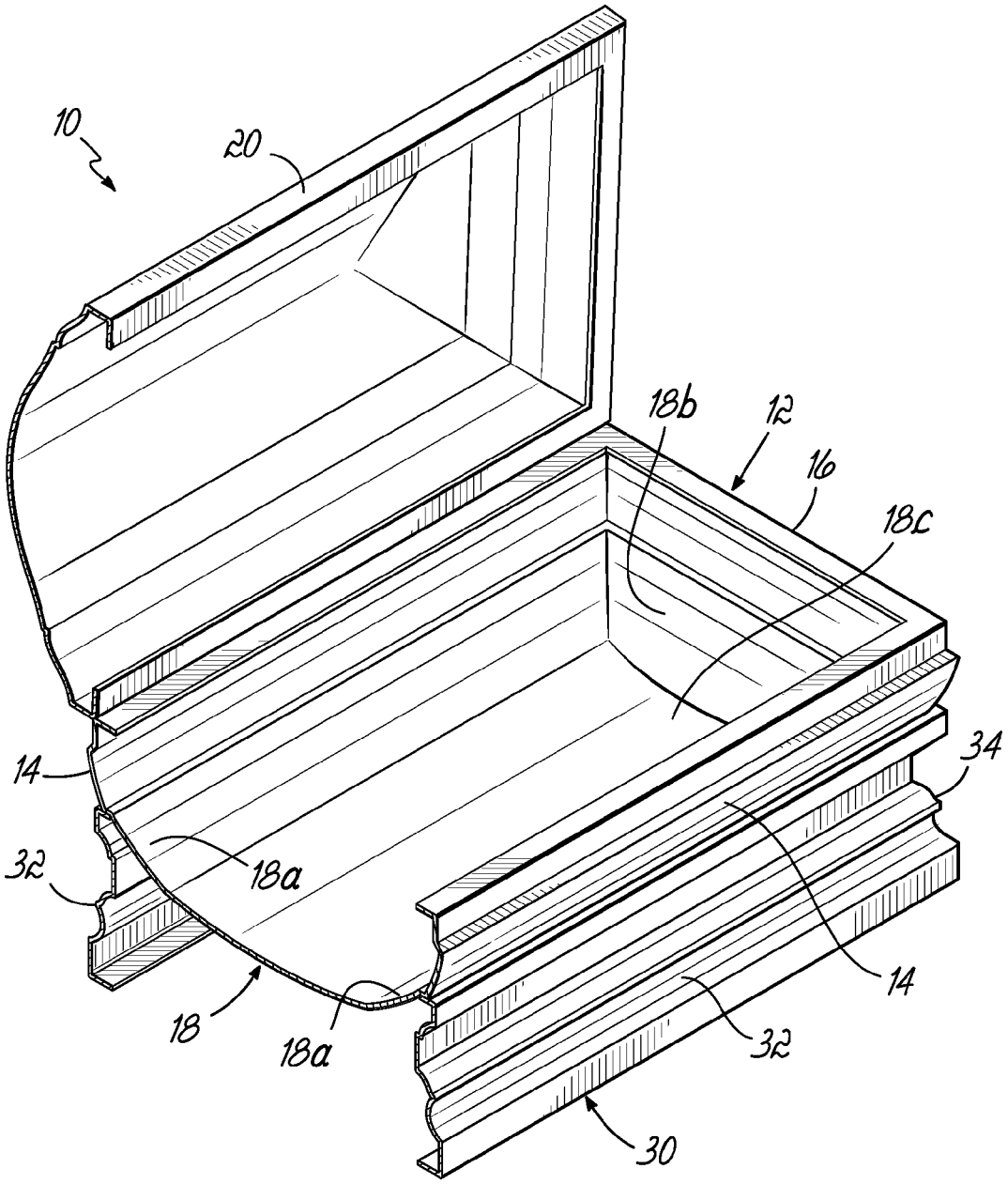
FIG. 4 is a lateral cross-sectional perspective view of the casket and casket display of FIG. 3.

Referring first to FIGS. 1-4, a casket 10 has a reduced height casket shell 12 adapted to receive the remains of a deceased. The reduced height casket shell 12 has a pair of side walls 14, 14, a pair of end walls 16, 16, and a bottom wall 18. A cap or lid 20 is closable on the shell 12. The casket 10 may have a pair of lids, or a single lid the full length of the casket as illustrated at 20, hingedly connected to shell 12. Conventional handle bars (not shown) could be permanently mounted to the side walls 14, 14 and end walls 16, 16. Alternatively, a carrying device could be removably positioned under the casket 10 for transporting the casket 10.

A casket display base 30 has a pair of side walls 32, 32 and a pair of end walls 34, 34. Optionally the display base 30 could include a bottom wall (not shown) but the same is not required. The casket 10 is supported by the display base 30 such that the lower edges 14*a*, 14*a* of the side walls 14, 14 and the lower edges 16*a*, 16*a* of the end walls 16, 16 of the reduced height casket shell 12 are at about the same height as the upper edges 32*a*, 32*a* of the side walls 32, 32 and the upper edges 34*a*, 34*a* of the end walls 34, 34 of the display base 30. For example, the lower edges 14*a*, 14*a* of the side walls 14, 14 and the lower edges 16*a*, 16*a* of the end walls 16, 16 of the reduced height casket shell 12 can be supported on the upper edges 32*a*, 32*a* of the side walls 32, 32 and the upper edges 34*a*, 34*a* of the end walls 34, 34 of the display base 30.

The bottom wall 18 of the reduced height casket shell 12 extends below the lower edges 14*a*, 14*a* of the side walls 14, 14 and the lower edges 16*a*, 16*a* of the end walls 16, 16 of the reduced height casket shell 12, preferably by about 3.5 inches. This allows the lower portion of the reduced height casket shell 12 to nest within the display base 30. In the illustrated embodiment, the bottom wall 18 is concave (as viewed from above) or otherwise pan-shaped, in that side 18*a*, 18*a* and end 18*b*, 18*b* portions of the bottom wall 18 taper inwardly and downwardly toward central portion 18*c* of the bottom wall 18, which itself in the illustrated embodiment is also concave (as viewed from above). The side walls 14, 14 and end walls 16, 16 of the reduced height casket shell 12 are preferably, but not necessarily, about 6 inches high, and the side walls 32, 32 and end walls 34, 34 of the display base 30 are preferably, but not necessarily, about 12 inches high. Thus, the combined height of the assembled reduced height casket shell 12 and display base 30 is about 18 inches, which is roughly about the same as, or at least only slightly greater than, a conventional height casket shell of 15.5 inches. Moreover, the cross-sectional profiles of the side walls 14, 14 and end walls 16, 16 of the reduced height casket shell 12 and of the side walls 32, 32 and end walls 34, 34 of the display base 30 can be selected such that, once the casket 10 and base 30 are assembled, the combined profiles of the casket 10 and base 30 closely match the desired cross-sectional profile of a given conventional height casket shell. Thus, the reduced height casket shell 12 used in conjunction with the display base 30 creates the appearance of a conventional height casket shell.

The shallow pan-shaped geometry of the reduced height casket shell 12 lends itself to being produced from a single piece of sheet metal in a stamping operation so as to be substantially seamless, similar to the manner in which the lid 20 is currently produced and has been produced for many years, and thus not requiring substantial welding, grinding of weld seams, and the like. The casket 10 and display base 30 can also be fabricated of wood, however.

The display base 30 can be fabricated in the same manner casket shells are currently fabricated, i.e. from two stamped side walls or panels 32, 32 and two stamped end walls or panels 34, 34 that are welded at their four corners.

Figure 5:
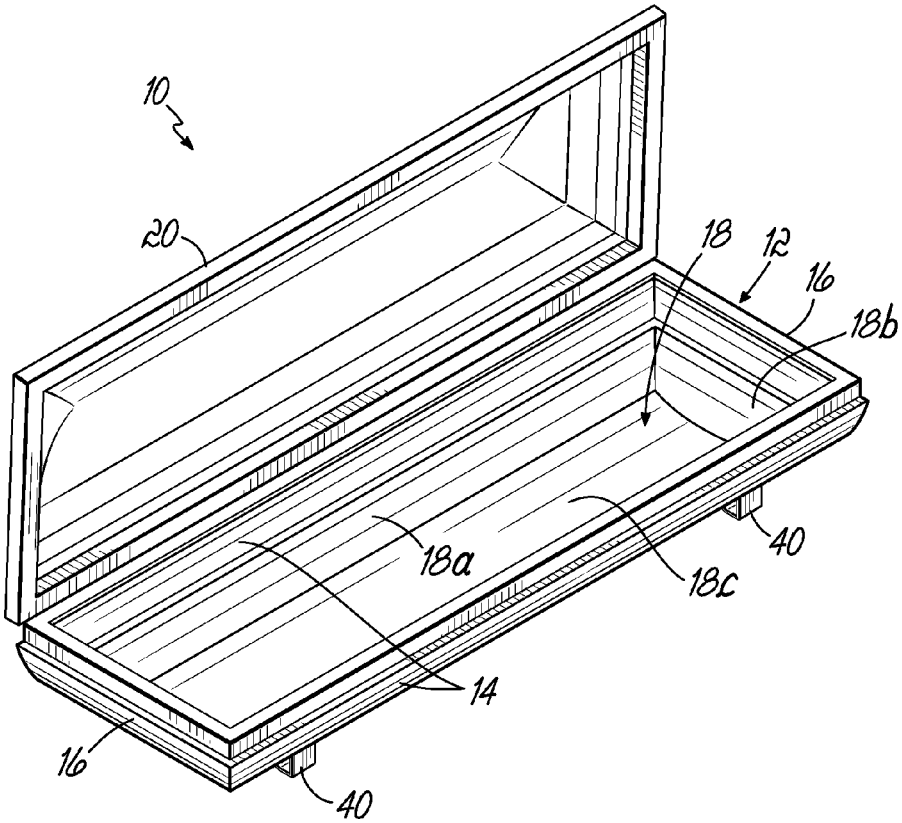
FIG. 5 is a perspective view of an alternative embodiment of the casket with the casket lid open.
Figure 6:
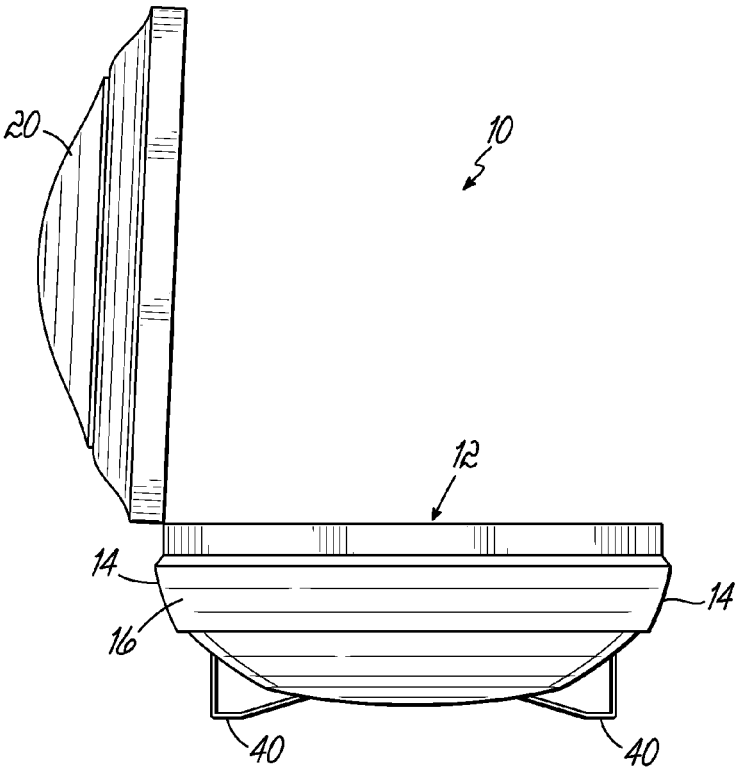
FIG. 6 is a side view of the casket of FIG. 5.

Referring next to FIGS. 5 and 6, an alternative embodiment of the casket 10 is shown. With like numbers representing like elements, bottom wall 18 of the shell 12 has feet 40 which can be permanently or removably attached to the bottom wall 18. The feet 40 allow the casket 10 to be displayed on a floor or table surface in a stable, horizontal attitude without the need for a display base 30. Due to the curvature of the bottom wall 18 of the casket 10, in the absence of feet 40 the casket 10 would rock back and forth if displayed on a floor or table surface. Feet 40 thus provide a stable means of displaying casket 10 other than in/on display base 30.

Figure 7:
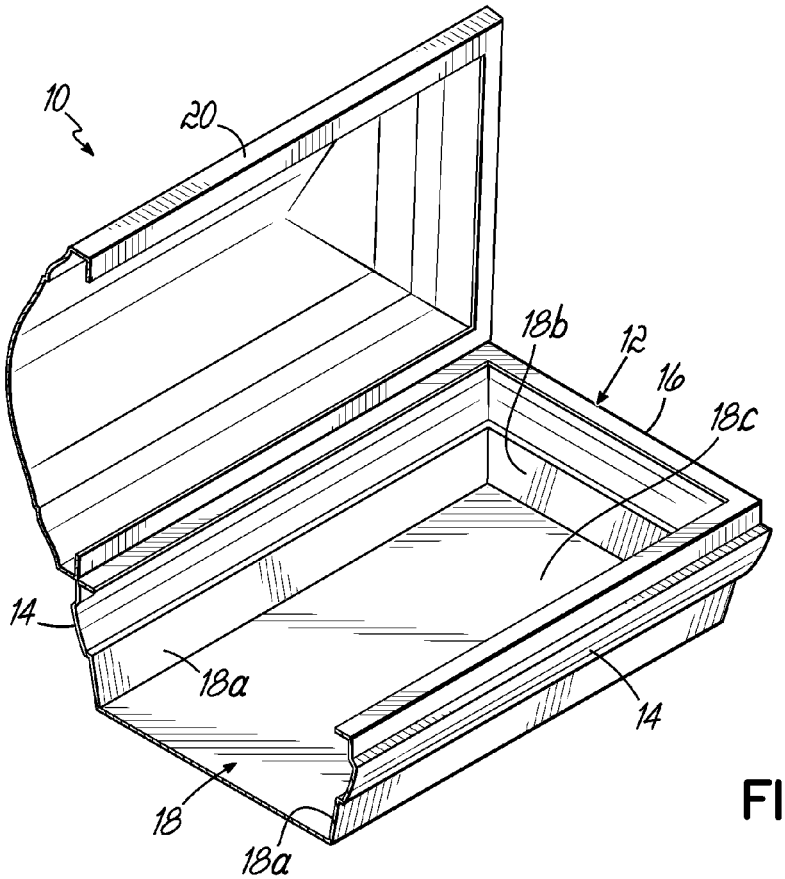
FIG. 7 is a lateral cross-sectional perspective view of an alternative embodiment of the casket with the casket lid open.
Figure 8:
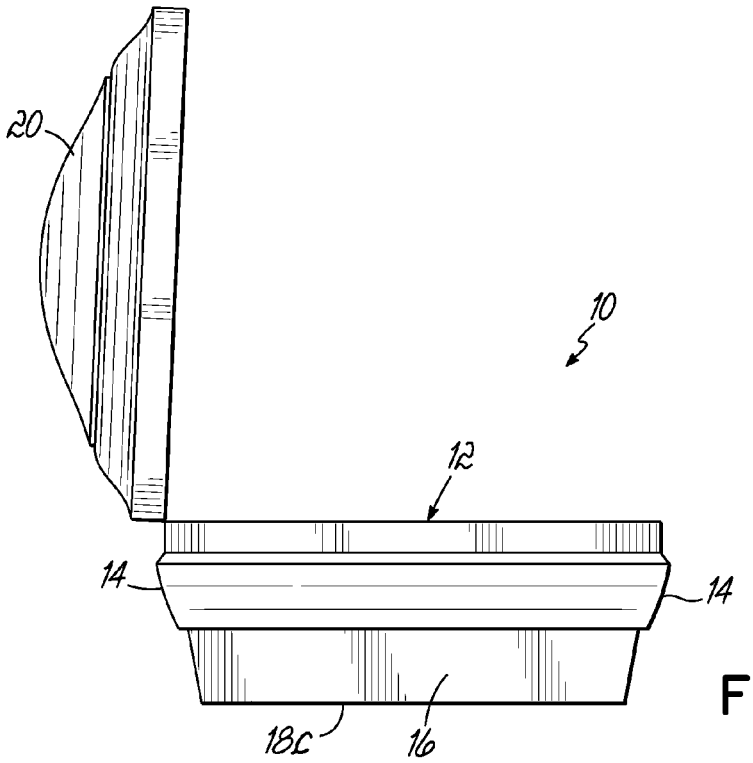
FIG. 8 is a side view of the casket of FIG. 7.

Referring next to FIGS. 7 and 8, another alternative embodiment of the casket 10 is shown. With like numbers representing like elements, the bottom wall 18 of the shell 12 is flat rather than curved as shown in FIGS. 3-6. The flat bottom 18 of the shell 12 allows the casket 10 to be displayed in a stable, horizontal attitude without the need for either a display base 30 or feet 40.

Figure 9:
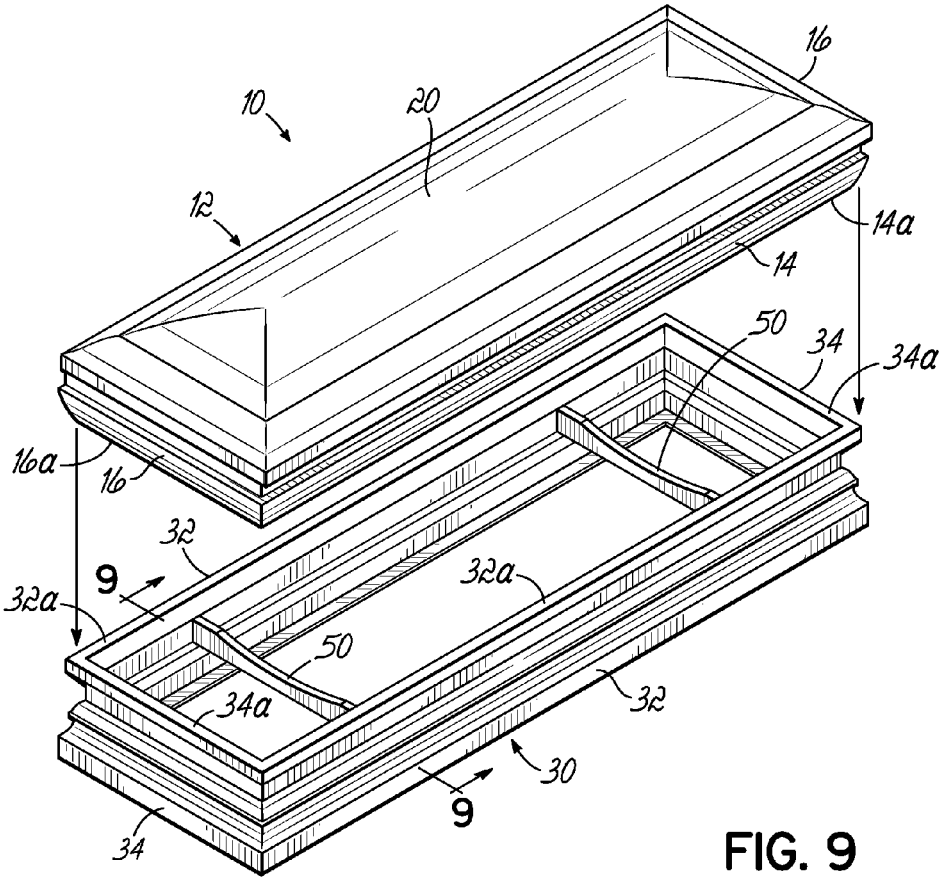
FIG. 9 is a disassembled perspective view of another alternative embodiment of the casket and casket display.
Figure 10:
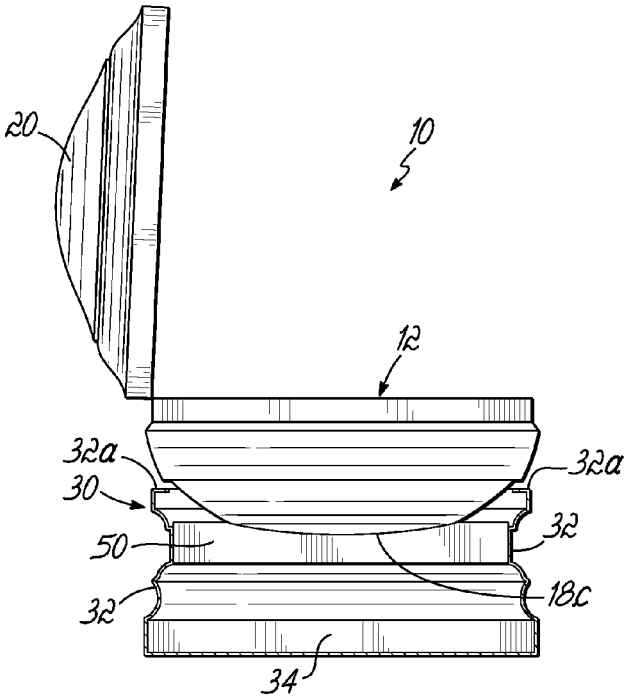
FIG. 10 is an assembled side view of the casket and casket display of FIG. 9 with the casket lid open.

Referring next to FIGS. 9 and 10, another embodiment of the casket 10 and display base 30 is shown. With like numbers representing like elements, the bottom wall 18 of the casket 10 of FIGS. 9 and 10 is supported on a pair of cradles 50, 50 mounted in the display base 30. This provides an alternative way of supporting the casket 10 on the display base 30 other than supporting the lower edges 14*a*, 14*a* of the side walls 14, 14 and the lower edges 16*a*, 16*a* of the end walls 16, 16 of the reduced height casket shell 12 of the casket 10 on the upper edges 32*a*, 32*a* of the side walls 32, 32 and the upper edges 34*a*, 34*a* of the end walls 34, 34 of the display base 30. Rather, the bottom wall 18 of the casket shell 28 is supported on the cradles 50, 50 which are themselves supported on/in the display base 30. Cradles 50, 50 could be permanently mounted in the display base 30 or removably mounted therein. Caskets 10 with either a flat bottom wall 18 or a curved bottom wall 18 can be used with a cradle-equipped display base 30.

Figure 11:
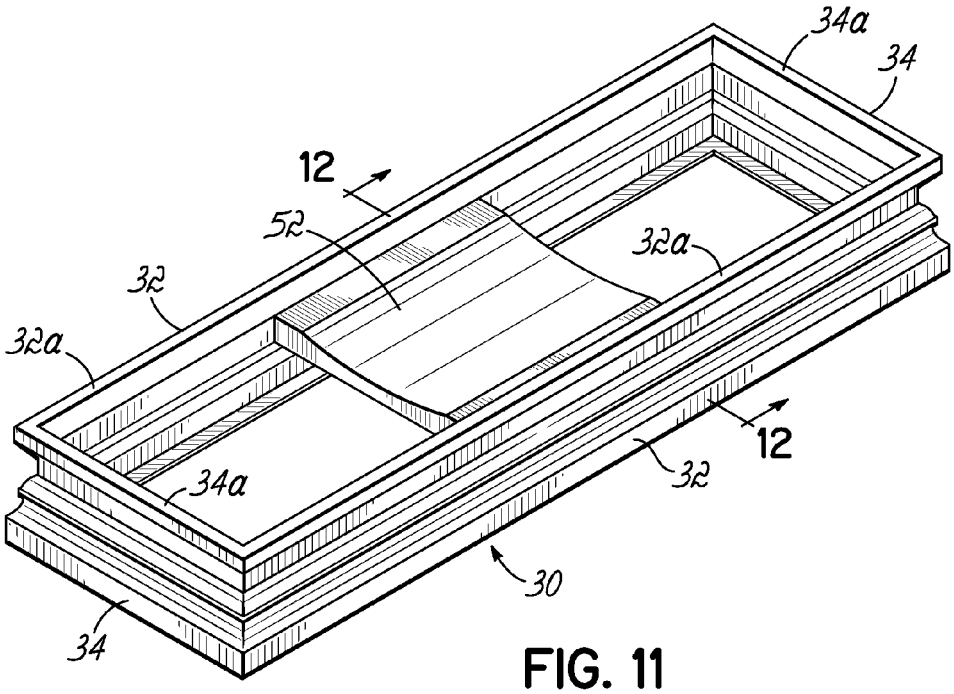
FIG. 11 is a perspective view of another alternative embodiment of the casket display.
Figure 12:
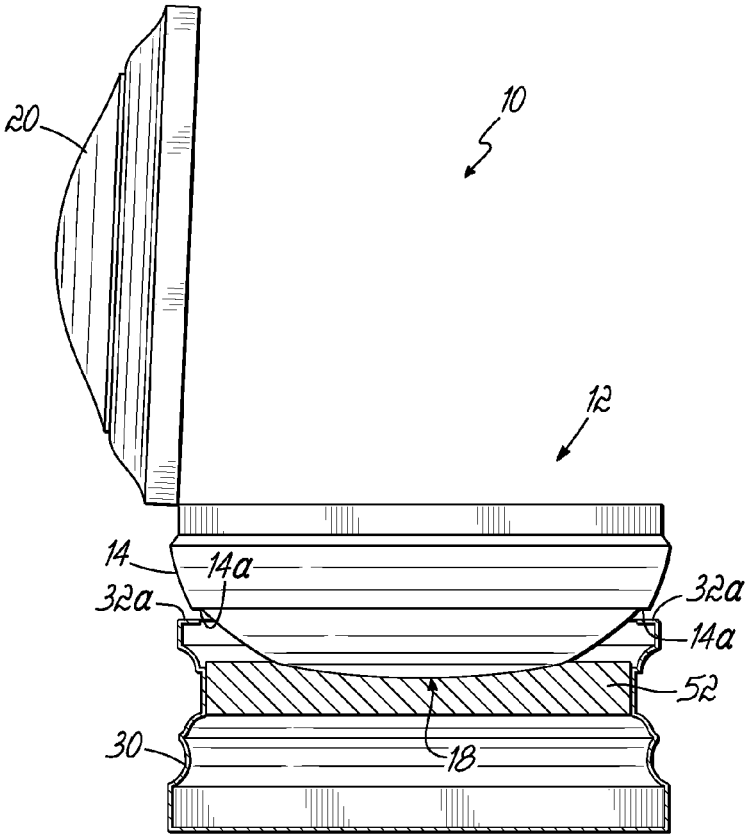
FIG. 12 is an assembled side view of the casket of FIGS. 1-4 and the casket display of FIG. 11 and with the casket lid open.

Referring next to FIGS. 11 and 12, a single, wider cradle 52 could be used in place of the pair of cradles 50, 50 of FIGS. 9 and 10. FIG. 12 shows use of the single, wider cradle 52 in conjunction with a casket 10 with a curved bottom wall 18, in which case the upper surface of the cradle 52 is concave to match the curvature of the curved bottom wall 18.

Figure 13:
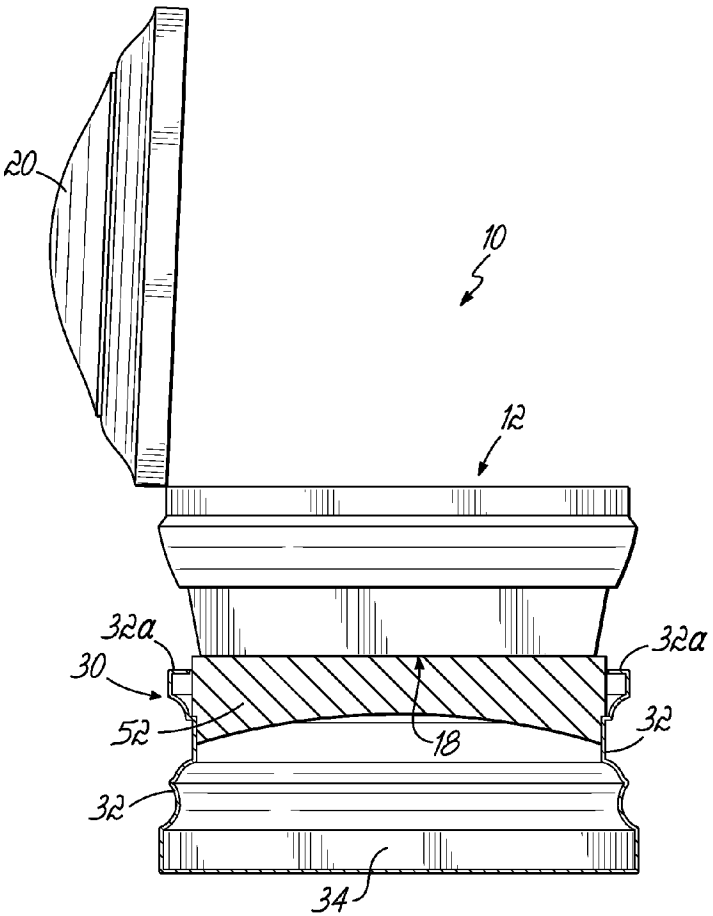
FIG. 13 is an assembled side view of another alternative embodiment of the casket and casket display with the casket lid open.

Referring next to FIG. 13, there is shown use of the single, wider cradle 52 in conjunction with a casket 10 with a flat bottom wall 18, in which case the upper surface of the cradle 52 is flat to match the flat bottom wall 18. In both the FIGS. 12 and 13 embodiments, the bottom wall 18 of the casket shell 12 is supported on the cradle 52, rather than the lower edges 14*a*, 14*a* of the side walls 14, 14 and the lower edges 16*a*, 16*a* of the end walls 16, 16 of the casket shell 12 being supported on the upper edges 32*a*, 32*a* of the side walls 32, 32 and the upper edges 34*a*, 34*a* of the end walls 34, 34 of the display base 30. In the case of the FIG. 12 embodiment, the cradle 52 is positioned in the display base 30 such that the upper surface of the cradle 52 is below the upper edges 32*a*, 32*a* of the side walls 32, 32 and the upper edges 34*a*, 34*a* of the end walls 34, 34 of the display base 30, the result being that the lower edges 14*a*, 14*a* of the side walls 14, 14 and the lower edges 16*a*, 16*a* of the end walls 16, 16 of the casket shell are supported at or above the upper edges 32*a*, 32*a* of the side walls 32, 32 and the upper edges 34*a*, 34*a* of the end walls 34, 34 of the display base 30, i.e. the casket shell 12 is nested within the display base 30. This stands in contrast to the FIG. 13 embodiment, where the cradle 52 is positioned in the display base 30 such that the upper surface of the cradle 52 is at or above the upper edges 32*a*, 32*a* of the side walls 32, 32 and the upper edges 34*a*, 34*a* of the end walls 34, 34 of the display base 30, the result being that the flat bottom wall 18 of the casket shell 12 of FIG. 13 is supported at or above the upper edges 32*a*, 32*a* of the side walls 32, 32 and the upper edges 34*a*, 34*a* of the end walls 34, 34 of the display base 30.

Figure 14:
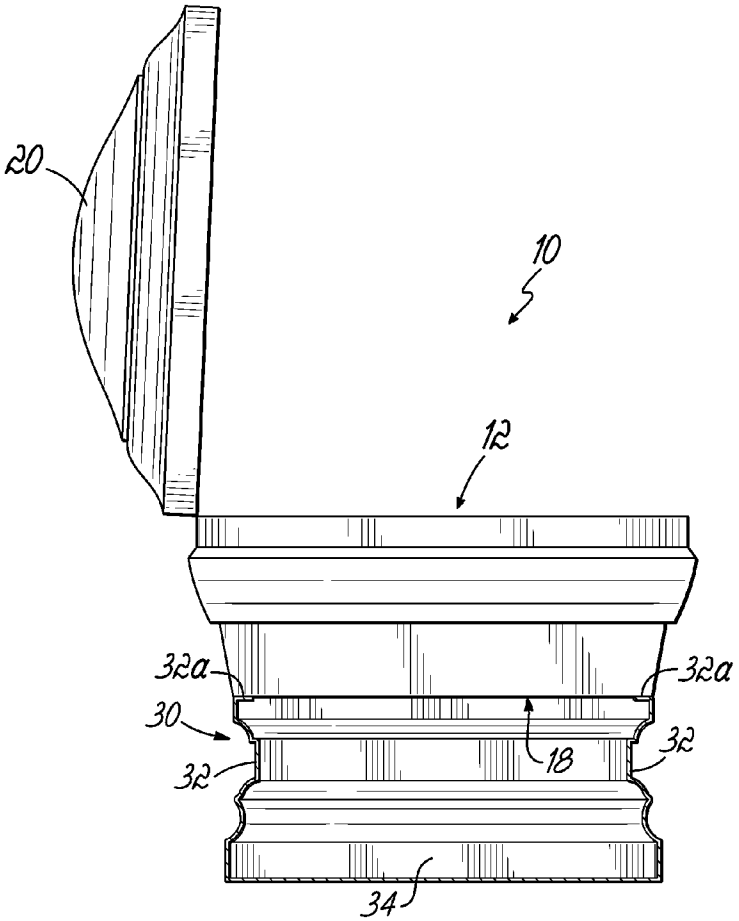
FIG. 14 is an assembled side view of another alternative embodiment of the casket and casket display with the casket lid open.

Referring next to FIG. 14, a casket 10 with flat bottom wall 18 is shown supported on the display base 30 by supporting the peripheral edges of the bottom wall 18 of the casket shell 12 on the upper edges 32*a*, 32*a* of the side walls 32, 32 and the upper edges 34*a*, 34*a* of the end walls 34, 34 of the display base 30.

Figure 15A:
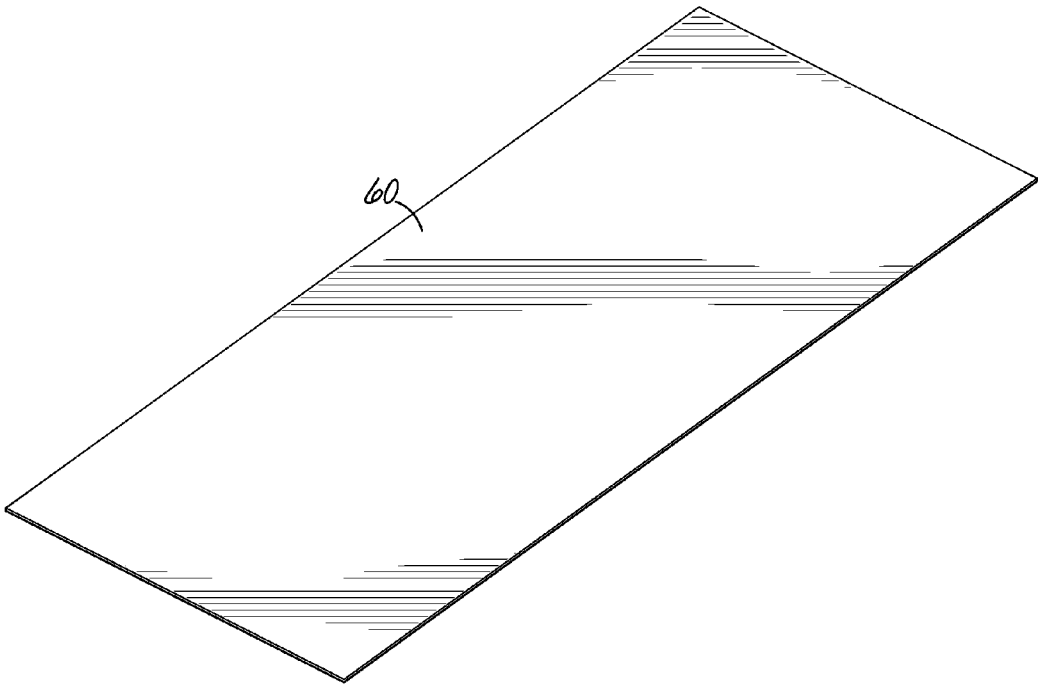
FIGS. 15A-15G illustrate steps in fabricating a casket shell from a single, continuous, seamless rectangular sheet of sheet metal.
Figure 15B:
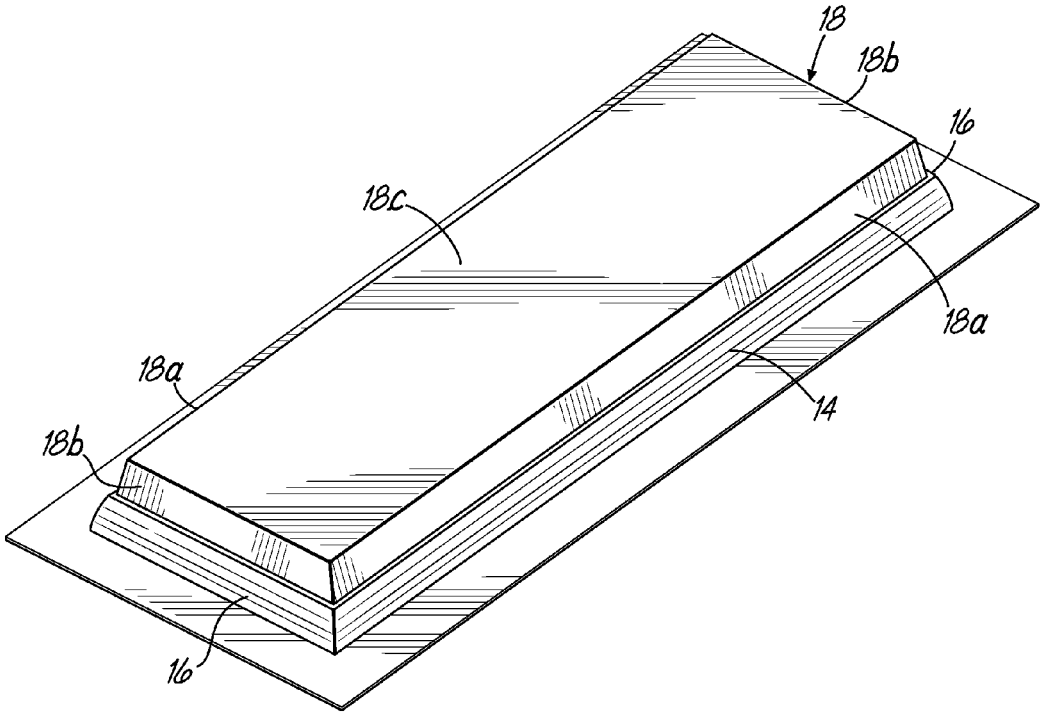

Referring next to FIGS. 15A-15G, exemplary steps in manufacturing a reduced height casket shell 12 are illustrated. Referring first to FIGS. 15A and 15B, a single, continuous, seamless rectangular sheet of sheet metal 60 is stamped to form the bottom wall 18 with side portions 18*a*, 18*a*, end portions 18*b*, 18*b*, and central portion 18*c*, and to form the side walls 14, 14 and end walls 16, 16.

Figure 15C:
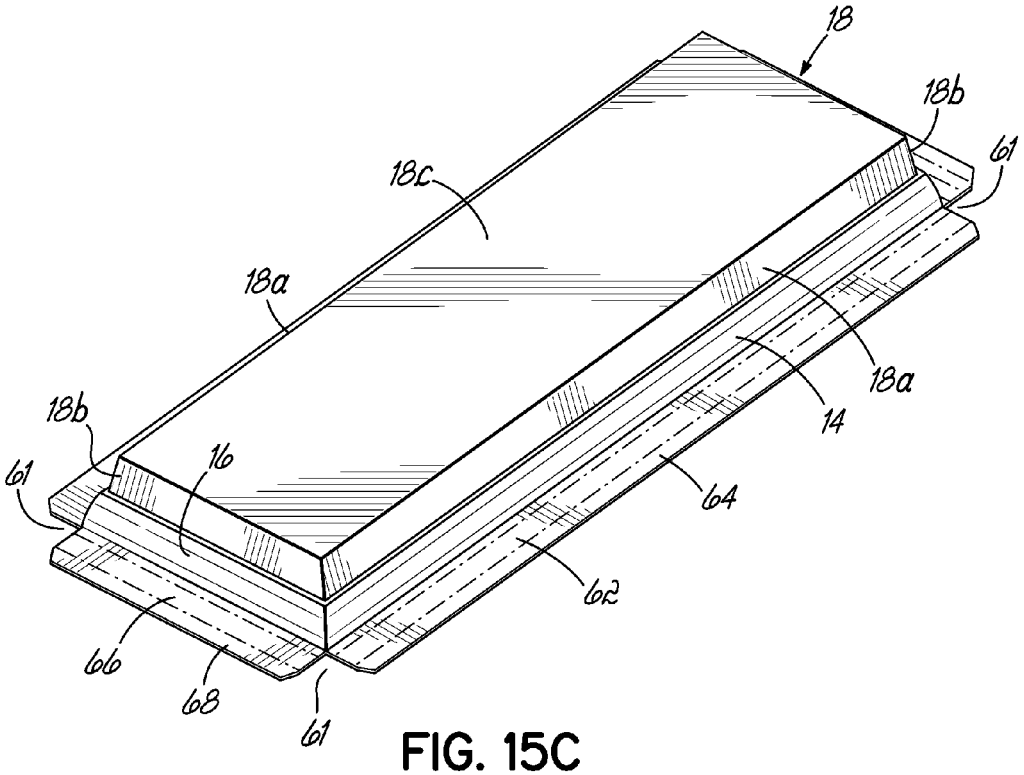
Figure 15D:
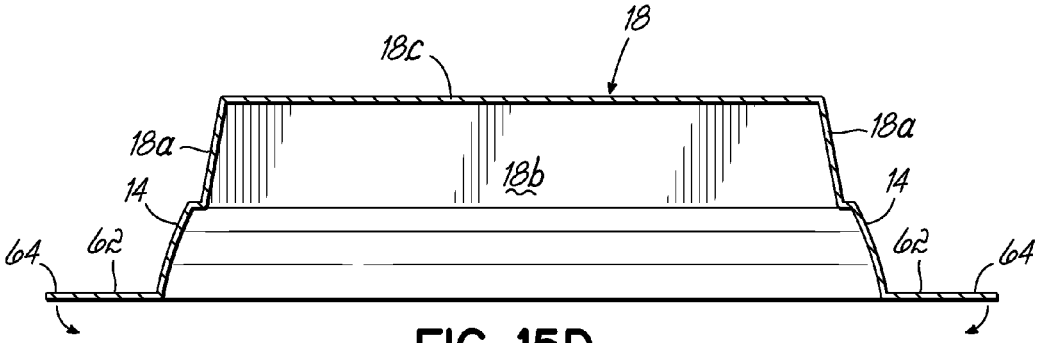
Figure 15E:
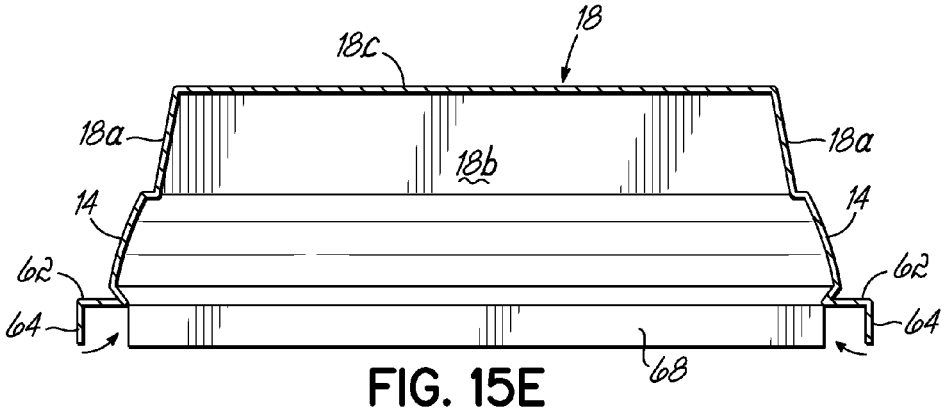

Referring next to FIGS. 15C-15E, the edges of the sheet 60 are trimmed, corners 61 are mitered at the corners of the sheet 60, and the side flange walls 62 and side flanges 64 and the end flange walls 66 and end flanges 68 are shaped. At the end of these steps, the side flange walls 62 and the end flange walls 66 are generally parallel to the central portion 18*c* of the bottom wall 18, and the side flanges 64 and the end flanges 68 are generally perpendicular to the central portion 18*c* of the bottom wall 18.

Figure 15F:
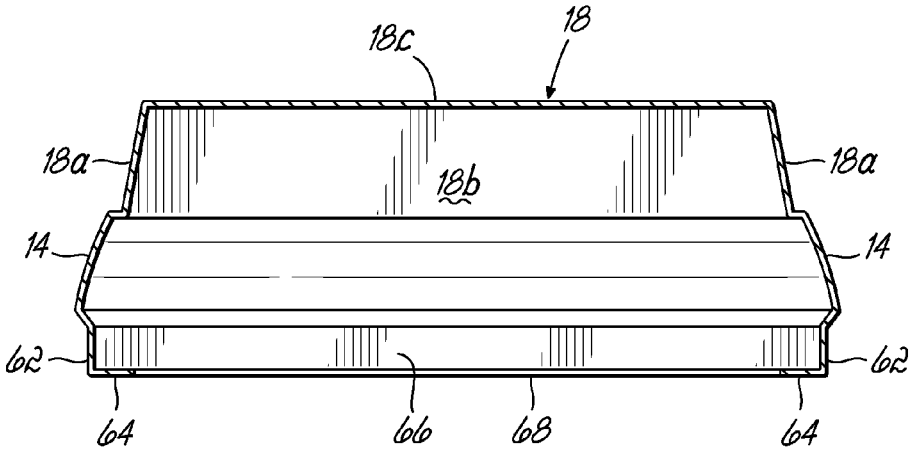

Referring next to FIG. 15F, the side flange walls 62 and side flanges 64 and the end flange walls 66 and end flanges 68 are bent inwardly by about 90 degrees. At the end of this step, the side flange walls 62 and the end flange walls 66 are generally perpendicular to the central portion 18*c* of the bottom wall 18, and the side flanges 64 and the end flanges 68 are generally parallel to the central portion 18*c* of the bottom wall 18.

Figure 15G:
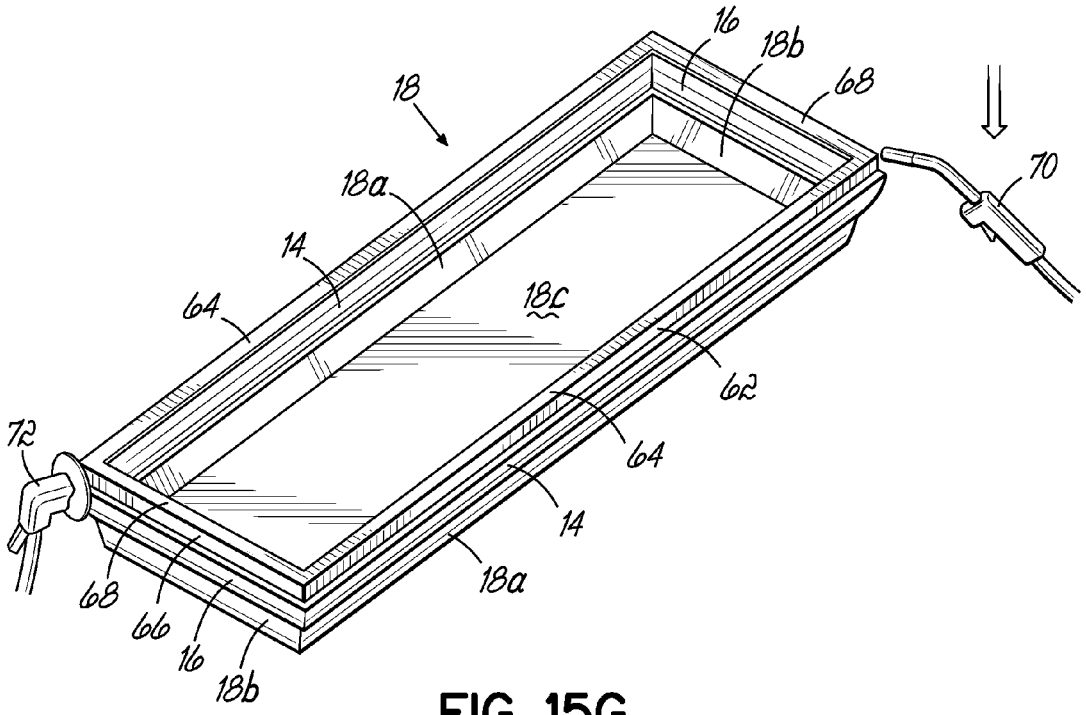

Referring next to FIG. 15G, the miter corners formed by adjacent abutting side flanges 64 and end flanges 68 are welded with welder 70, and the weld joints are ground smooth with grinder 72.

Compared to the current process of forming sheet metal casket shells discussed above, a sheet metal casket shell manufactured according to the steps of FIGS. 15A-15G does not require substantial welding. The current process of forming sheet metal casket shells discussed above requires the side walls and end walls to be welded together, the bottom wall to be welded to the side walls and end walls, and the side flanges and end flanges to be welded together. The process of FIGS. 15A-15G eliminates the need to weld the side walls and end walls together and to weld the bottom wall to the side walls and end walls, and eliminates the need to grind and finish sand those welds, thus saving substantial manufacturing steps, time, and costs.

The process of FIGS. 15A-15G is similar to the process by which sheet metal casket caps or lids are currently manufactured and have been manufactured for many years. Since the casket shell is adapted to receive the body of the deceased, the casket shell is deeper than the casket cap or lid. Accordingly, a casket shell formed by the process of FIGS. 15A-15G, even a reduced height casket shell, is deeper than a casket cap or lid formed by this process. Accordingly, sufficient "draft" must be built into the tooling to ensure that the stamped shell can be removed from the stamping tooling, to prevent tearing of the sheet metal during stamping, and the like. Initially, it was thought that the process of FIGS. 15A-15G only had applicability to the production of reduced height casket shells of the dimensions discussed above. However, it is believed that the process of FIGS. 15A-15G could be utilized to manufacture full height casket shells of the dimensions discussed above as well, provided the stamping dies are configured with sufficient draft to avoid the noted problems. One would likely encounter some limitations in the possible shell side wall/end wall cross-sectional profiles that could be produced with the process of FIGS. 15A-15G, however.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. For example, while a number of embodiments of the invention have been illustrated and described as being used with caskets having reduced height casket shells, the various embodiments of the invention are also usable with caskets having full height casket shells. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. A method of displaying a plurality of caskets comprising the steps of:

providing the plurality of caskets each having a reduced height casket shell adapted to receive remains of a deceased and having a pair of side walls, a pair of end walls, and a bottom wall that extends below the lower edges of the side walls and end walls and a casket lid closable on the reduced height casket shell, providing a casket display base having a pair of side walls and a pair of end walls, and sequentially positioning each of the plurality of caskets, one at a time, on the casket display base, wherein each of the plurality of caskets and the casket display base are configured such that a combined height of the reduced height casket shell of each of the plurality of caskets positioned on the casket display base and the display base is about equal to a height of a conventional height casket shell, wherein a height dimension of said side walls and end walls of said reduced height casket shell is about one third of the combined height of said reduced height casket shell and display base, and wherein the height dimension of said side walls and end walls of said reduced height casket shell is about two thirds of an overall depth of said reduced height casket shell, said overall depth extending from the upper edges of said side walls and end walls of said reduced height casket shell to the lowermost point on said bottom wall.

2. The method of claim 1 wherein each of the plurality of caskets and the casket display base are configured such that the reduced height casket shell of each casket is supported by the casket display base such that the lower edges of the side walls and end walls of the reduced height casket shell are at about the same height as the upper edges of the side walls and end walls of the casket display base, and such that the bottom wall of the reduced height casket shell extends below the upper edges of the side walls and end walls of the casket display base so as to nest within the casket display base.

3. The method of claim 2 wherein the step of positioning each of the plurality of caskets on the casket display base comprises supporting the lower edges of the side walls and end walls of the reduced height casket shell on the upper edges of the side walls and end walls of the casket display base.

4. The method of claim 2 wherein the step of positioning each of the plurality of caskets on the casket display base comprises supporting the bottom wall of the reduced height casket shell on at least one cradle mounted in the casket display base.

5. The method of claim 1 wherein the cross-sectional profiles of the side walls and end walls of the reduced height casket shell and of the side walls and end walls of the display base are configured such that the combined profiles of the reduced height casket shell and base closely match a desired cross-sectional profile of a desired conventional height casket shell.

6. The method of claim 1 wherein the plurality of caskets and the casket display base are fabricated of sheet metal.

7. The method of claim 6 wherein the reduced height casket shell is stamped from a single piece of sheet metal so as to be substantially seamless.

8. The method of claim 1 wherein the plurality of caskets and the casket display base are fabricated of wood.

* * * * *